United States Patent [19]

Brown, Jr.

[11] 4,372,329

[45] Feb. 8, 1983

[54] COMPRESS ROLLER CURLER

[76] Inventor: Alphonso W. Brown, Jr., 56 Alberge La., Baltimore, Md. 21220

[21] Appl. No.: 270,984

[22] Filed: Jun. 5, 1981

[51] Int. Cl.[3] ..... A45D 2/00

[52] U.S. Cl. ..... 132/40

[58] Field of Search ..... 132/40, 42

[56] References Cited

U.S. PATENT DOCUMENTS

| | | | |
|---|---|---|---|
| D. 160,373 | 10/1950 | Davis et al. | 132/40 X |
| 2,042,397 | 5/1936 | High et al. | 132/40 |
| 2,173,872 | 9/1939 | Barnes | 132/40 |
| 2,256,143 | 9/1941 | Dunlavy | 132/40 |
| 2,433,141 | 12/1947 | McPherson | 132/40 |
| 2,625,941 | 7/1953 | Harrington | 132/42 R |
| 3,216,427 | 11/1965 | Jefferson | 132/40 |

*Primary Examiner*—G. E. McNeill

*Attorney, Agent, or Firm*—John F. McClellan, Sr.

[57] ABSTRACT

A hair treating system which produces radially oriented curls has a resiliently collapsible tubular body with a larger diameter top at the outer end and a similar but preferably open-ended bottom; features of the top and bottom provide for holding the unit in axially collapsed mode after the user has engaged it to the scalp using a comb-like appendage at the bottom and has wound a tress of hair around the body and pressed the top of the unit toward the user's head; special hair guiding and holding structures are described in various embodiments, including a provision permitting giving different treatment to free ends of the tresses.

1 Claim, 9 Drawing Figures

COMPRESS ROLLER CURLER

FIELD OF THE INVENTION

This invention relates generally to hair treatment and particularly to a system for setting hair in desired configurations.

BACKGROUND OF THE INVENTION

In modern hair styling it is customary for people who want to look their best to reshape their hair by forming it around curlers or the like, usually after, or in conjunction with shampooing or other treatment by liquid and/or heat. However, all curlers available to date are believed to share one or more disadvantages. A big disadvantage is awkard curler shape which makes the user uncomfortable when resting, with a tendency to pull the hair and dig into the scalp, and which has an untidy appearance, pointing in various directions and showing different amounts of hair wrapped around in different ways, and held by obtrusive members.

Another big disadvantage with conventional curler design is in the type curl produced, normally a curl with the axis tangent to the head of the user.

Other disadvantages of conventional curler design include bulkiness, slowness and difficulty in applying to the hair and sometimes in removal from the hair, monotonous and undefined showings of tint and shape.

OBJECTS OF THE INVENTION

Principal objects of the present invention therefore are to provide a unique new hair curler which applies and which detaches almost instantly, is compact and easy on the head and hair, which produces a superior result in straightening, curling and/or frizzing ends as desired, which produces curls with curlaxis generally radial to the head for greater beauty and versatility in styling, and which is a thing of beauty in itself, each having a circular end-panel well adapted for showing as a bright color disk parallel with the plane of the head, in groups giving to users a striking new look replacing drab old hair curlers.

Still further objects are to provide a curler as described which subordinates the appearance of the hair being treated to a decorative disk assemblage appearance which eliminates need for a head covering when appearing in public with the hair in curlers.

BRIEF SUMMARY OF THE INVENTION

In brief summary given as cursive description only and not as limitation the invention includes a flexibly compressible and fastenable cylindrical member with a preferably closed top and a comblike securance at the bottom; in preferred embodiment the closed top is a bright-color decorative disk, and hair-guide convolutions are provided externally on the cylindrical portion.

DETAILED DESCRIPTION OF THE DRAWINGS

Figure 1:
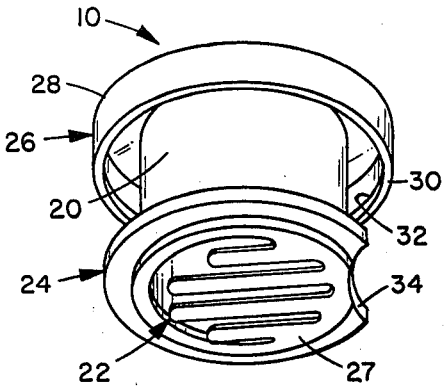
FIG. 1 is a bottom perspective view of the first embodiment.
Figure 2:
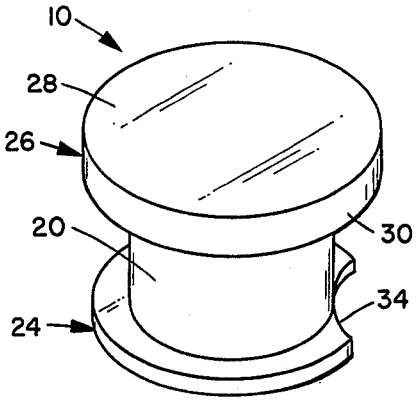
FIG. 2 is a top perspective view thereof.

FIGS. 1 and 2 show the invention 10 as comprising a unitary system which includes a thinwall resilient cylindrical body 20 of soft rubber or the like having at the bottom or inner end a comb-like appendage 22 for engaging hair adjacent a user's scalp and having at the perimeter of the inner end first means for engaging 24 connectable with second means for engaging 26 at the perimeter of the outer end, for detachably holding the cylindrical body in axially-collapsed configuration during use.

The top 28 of the unit is preferably closed or substantially closed, and larger in diameter than the cylindrical body, with which it is preferably coaxial.

The first means for engaging 24 may be a coaxial circular flange adjacent the bottom of the body and the second means for engaging 26 may include a skirt 30 peripherally dependent from the top a distance greater than the thickness of the first means for engaging, and with all or a portion of an annulus forming an inturned flange 32 around the bottom of the skirt to retain the first means for engaging 24 in the second means for engaging when the cylindrical body is axially compressed so that the two engaging means snap together. The member 24 may have one or more openings 34 for passage of hair strands peripheral opening 34 being in position for receiving hair from said comb-like appendage.

To use the system of this invention the person whose hair is to be curled or straightened, or frizzed at the ends in combination with either curling or straightening, if desired, wets the hair as by shampooing and then, after combing it, first engages the inner end of a curler 10 with the hair at the scalp, using the comb-like appendage 22. This may comprise a plurality of comb-like tines extending parallel from one side of the bottom of the unit, which may be open at the bottom.

The user, as the second step, winds an adjacent tress of hair around the cylindrical body any desired number of times, guided by the circular end enlargements, the number of times depending on hair length and curler size, and finally, as the third step, presses the top 28 of the curler towards the head of the user until the first and second engaging means, 24 and 26, interconnect and hold the curler in compressed configuration against the scalp.

To help in snapping the outer or second engaging means 26 over the inner or first engaging means 24 a central portion 27 of the bottom may protrude axially downward, leaving a gap between the member 24 and the user's scalp.

These three steps are repeated with other curlers until all tresses around the head are similarly treated.

The curlers are left in place for any desired length of time and then are removed by releasing each curler in turn, slipping the comb-like appendage free, and slipping the curler from under the curl formed by it.

To release the engaging means the rim of the top 28 is raised while the center of the top is depressed; this can easily be done with one hand.

With the curlers in place the user can recline without discomfort of curler pressure because the broad inner ends of soft rubber or soft plastic and the soft comb-like appendages spread and cushion the pressure. Similarly, curler-pull is relieved because there is no torque applied to this type curler when the outer end is pressed toward the head, in contrast with the usual roller action under pressure, which can actually produce bald spots.

It will be appreciated that the heat of the scalp may tend to help curl the hair even if the hair is dry.

Figure 3:
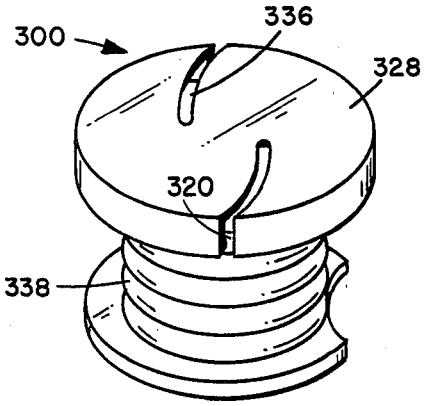
FIG. 3 is a top perspective view of a second embodiment.

FIG. 3 shows a further embodiment 300 which may have one or more slots 336 in the top 328 through the rim portion and through a portion of the cylindrical body 320; these provide for anchoring the ends of strands of hair wound around the body.

Terminal ends of the hair strand emerging through the slots may be frizzed, if desired, or otherwise treated apart from the coiled portions. Also shown in this embodiment is a corrugated or bellowslike series of convolutions 338 of the wall of the cylindrical body, which may be molded this way so that it collapses easier and in a more predictable manner.

Figure 4:
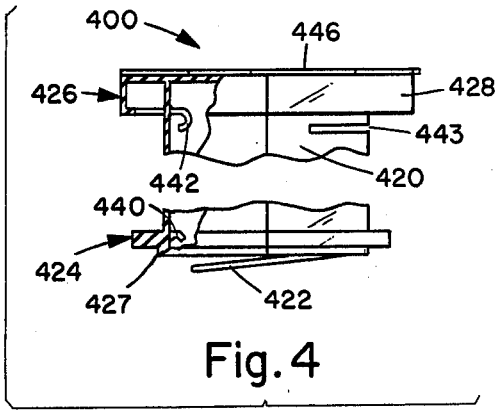
FIG. 4 is a fragmentary, partially sectional elevational view of a third embodiment.

FIG. 4 shows in partial section and fragmentarily an embodiment 400 which may have first 424 and second 426 engaging means like those of the first embodiment. Alternatively, or together with these, a first set of hooks 440 may protrude radially inward from adjacent the bottom of the cylindrical body interior in position to be engaged by a second set of hooks 442 correspondingly located around an upper portion of the cylindrical body interior for holding the cylindrical body in compressed mode. The hooks may be released by buckling the flexible top.

Also shown in this embodiment is a slot 443 through the upper wall of the tubular body; such slots may be in circumferential direction, and will, in any event help hold the ends or other portions of hair passed through them.

Also shown here are the protrusion 427 and comb-like appendage 422. This Figure is fragmentary, to indicate that the length or height of the unit may be short or long, as desired.

In addition, FIG. 4 illustrates other important advantages in that the cross-sectional shape of the top 428 can be polygonal for decorative purposes as can the body 420 and bottom. Further, a shape or color or design changer 446 can be cemented or otherwise provided for the top; this may be, for example, alphabetical, numerical, zodiacal, floral or other shape or design, larger or smaller than the top.

Figure 5:
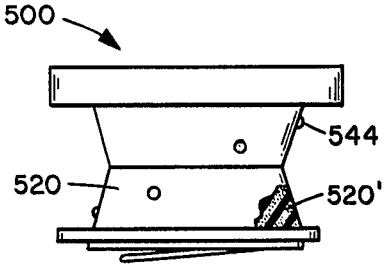
FIG. 5 is a partially fragmentary elevational view of a fourth embodiment.

FIG. 5 shows an embodiment 500 generally like the others but with an hourglass or truncated-cone shaped body 520 affording another mode of collapsing. It is evident that such configuration on axial collapse may tend to tighten the hair helix wound around the body. Proportions of diameter to height is shown different in this and the following embodiment, indicating flexibility of adaption to various sizes. Also shown are nibs 544, small rounded protrusions to help guide hair.

This Figure shows another feature, the material as at 520' can be sponge or foam rubber or plastic, the entire unit can be solid if compressible enough and many available materials will permit this.

Figure 6:
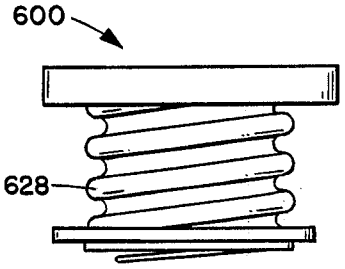
FIG. 6 is an elevational view of a fifth embodiment.

FIG. 6 shows embodiment 600 which has a body with bellows wall having spiral convolutions 628 so that wound strands will be constrained or guided in a spiral path outward around the body. It will be evident that features among the various embodiments can be interchanged without departing from the principles of the invention.

Figure 7:
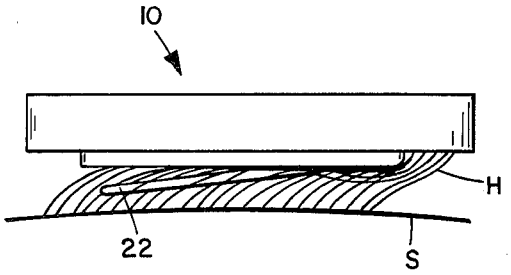
FIG. 7 is a perspective view of an embodiment in collapsed, use mode.

FIG. 7 shows an embodiment 10 in collapsed configuration, holding a tress of hair H along the scalp S of a user.

Figure 8:
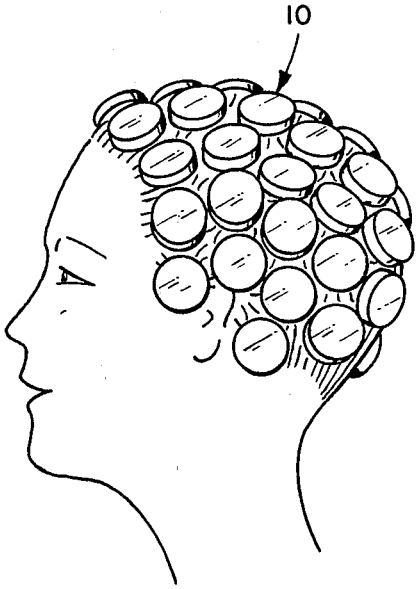
FIG. 8 is a perspective view of a user wearing a plurality of units of an embodiment.

FIG. 8 shows a representative plurality of the curlers 10 in use, substantially covering the head of a user, to which they cling closely and largely conceal the hair, which in the part visible includes neat swirls.

As a preferred feature the tops of the curlers are closed ends or disk-like panels, which may be all of one color, of different colors, or of reflective material or diffractive material, forming a strikingly beautiful cap-like array. The user need not cover these medallions when going out while wearing them because they are intrinsically attractive as worn, and almost infinitely variable so that such user can design a unique personal effect. The tops may be all of the same size or of different sizes permitting the user to form size-patterns. The various markings shown various colors, etc.

Figure 9:
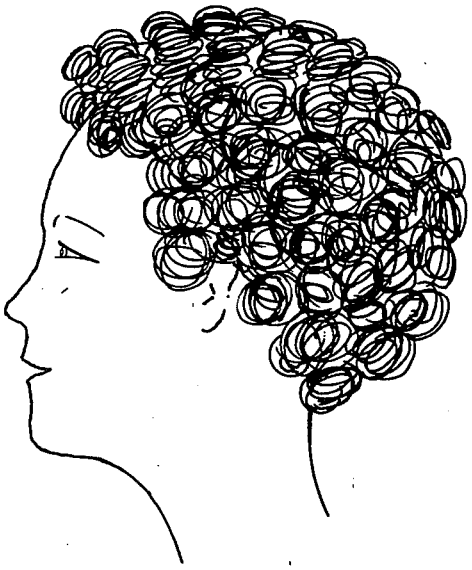
FIG. 9 is a view of a user's hair demonstrating one unusual result achievable with the invention.

FIG. 9 shows a user's head after the curlers are removed and before any further styling. The individual ringlets are uniquely oriented in a radial direction to the user's head, producing an unusual and becoming appearance.

At least two representative sizes are contemplated:

1. top diameter 1½ inches (3.6 cm) (the bottom may be the same or slightly smaller) body diameter 1 inch (2.5 cm) body height 1¼ inch (3.1 cm) collapsed height 5/16 inch (0.8 cm)
2. top diameter 1 inch (2.5 cm) body diameter ¾ inch (1.8 cm) body height 1 inch (2.5 cm) collapsed height 5/16 inch (0.8 cm)

This invention is not to be construed as limited to the particular forms disclosed herein since these are to be regarded as illustrative rather than restrictive. It is, therefore, to be understood that the invention may be practiced within the scope of the claims otherwise than as specifically described. For example, soft plastic construction may be used as one means for rendering the structure resiliently collapsible.

What is claimed and desired to be protected by United States Letters Patent is:

1. In a system for treating strands of hair on a human scalp, comprising a tubular body having an outer end and an inner end, said body being of material rendering said body resiliently compressible axially; guide means, including bellows-like convolutions in the body, for winding said hair; a respective flange-like member, larger in diameter than the body, on the outer end of the body and on the inner end of the body; and means for holding the body axially compressed for gripping hair wound around the body, the improvement comprising: said inner flange-like member having: a comblike securance thereon at the bottom inner end of the body for engaging the hair of a user, and a peripheral opening therein in position for receiving from said comblike securance said hair engaged by said comblike securance; said body having a circumferential slot through the upper wall thereof to help hold ends of hair wound around said body in said spiral convolutions, and the outer flange-like member and the inner flange-like member having respective engaging means for snapping them together into engagement when said body is axially compressed, for holding said hair wound on said body.

* * * * *